US011549470B2

(12) United States Patent
Furutani et al.

(10) Patent No.: US 11,549,470 B2
(45) Date of Patent: Jan. 10, 2023

(54) INTAKE MANIFOLD STRUCTURE

(71) Applicant: MAZDA MOTOR CORPORATION, Hiroshima (JP)

(72) Inventors: Masayuki Furutani, Hiroshima (JP); Akira Ichigi, Hiroshima (JP); Masahiro Nishioka, Hiroshima (JP); Takuya Yamada, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 17/744,925

(22) Filed: May 16, 2022

(65) Prior Publication Data

US 2022/0381206 A1 Dec. 1, 2022

(30) Foreign Application Priority Data

May 26, 2021 (JP) ..... JP2021-088647

(51) Int. Cl.
*F02M 35/10* (2006.01)
*F02M 35/104* (2006.01)

(52) U.S. Cl.
CPC .... *F02M 35/104* (2013.01); *F02M 35/10321* (2013.01)

(58) Field of Classification Search
CPC ..... F02M 35/104; F02M 35/10321; F02M 35/10288
See application file for complete search history.

(56) References Cited

U.S. PATENT DOCUMENTS

2016/0153409 A1* 6/2016 Sudo ..... F02M 35/104
123/184.61
2019/0136805 A1* 5/2019 Tanaka ..... F02M 35/104
2021/0033050 A1* 2/2021 Oda ..... F02M 35/10222

FOREIGN PATENT DOCUMENTS

JP 5699635 B2 4/2015

* cited by examiner

*Primary Examiner* — Syed O Hasan
(74) *Attorney, Agent, or Firm* — Studebaker & Brackett PC

(57) ABSTRACT

Interference between an intake manifold and a fuel pipe during a vehicle front collision is prevented in an engine which is longitudinally mounted in an engine room. A vehicle component is arranged on the front side of an intake manifold, and a fuel pipe is arranged on the rear side of the intake manifold. The intake manifold includes a mounting portion on the intake-air downstream end side of a plurality of independent intake pipe portions and connects each of the plurality of independent intake pipe portions to a portion of the engine on one side of the engine in the vehicle width direction. The mounting portion has a front-side mounting portion relatively positioned on the front side and a rear-side mounting portion relatively positioned on the rear side, and the rear-side mounting portion has a higher rigidity than the front-side mounting portion.

10 Claims, 10 Drawing Sheets

INTAKE MANIFOLD STRUCTURE

TECHNICAL FIELD

The technology disclosed herein belongs to a technical field relating to an intake manifold structure.

BACKGROUND ART

Hitherto, consideration has been given to dealing with a vehicle collision using the structure of an intake manifold connected to an engine.

For example, Japanese Patent Laid-Open. No. 2012-158994 discloses a front structure of an engine laterally placed in an engine room such that the cylinder array direction is in the vehicle width direction. In the front structure, an intake manifold made of resin is fastened on the vehicle front side of the engine at an upper portion and a lower portion thereof, a fuel distribution pipe that extends in the crank shaft line direction is arranged below an upper mounting portion of the intake manifold, the intake manifold is formed in a manner of being split to the side close to the engine and the side far from the engine and is composed of a plurality of joined split bodies, the strength of a base split body on the side close to the engine is set to be higher than that of another split body on the side far from the engine, an oil separator cover made of resin is provided on the vehicle front face side of the engine, and retreat restriction portions that abut against each other in the process of displacement of the base split body at the time of a collision are provided on the base split body and the oil separator cover.

SUMMARY

When the engine is arranged such that the cylinder array direction is in the vehicle front-rear direction, the intake manifold is arranged on one side of the engine in the vehicle width direction. At this time, a fuel pump and a fuel pipe connected the fuel pipe may be arranged on a portion of the engine on the rear side thereof, and vehicle components such as an alternator may be arranged on a portion of the engine on the front-side thereof. In the configuration as above, at the time of a vehicle front collision, the vehicle components retreat and abut against the intake manifold. As a result, when the intake manifold retreats in a pileup manner, the intake manifold might interfere with the fuel pipe.

The engine structure described in Japanese Patent Laid-Open. No. 2012-158994 is a configuration that prevents interference between the intake manifold and the fuel pipe on the premise that the engine is laterally placed in the engine room. Therefore, the engine structure does not prevent the interference between the intake manifold and the fuel pipe when the engine is longitudinally placed in the engine room. Therefore, there is room for improvement from the viewpoint of preventing the interference between the intake manifold and the fuel pipe when the engine is longitudinally placed in the engine room.

The technology disclosed herein has been made in view of this point, to prevent an intake manifold and a fuel pipe from interfering with each other at the time of a vehicle front collision when an engine is longitudinally placed in an engine room.

In order to solve the abovementioned problem, in a technology disclosed herein, an intake manifold structure including an intake manifold connected to a portion of a multiple cylinder engine on one side of the multiple cylinder engine in a vehicle width direction has the following configuration, the multiple cylinder engine being longitudinally placed in an engine room such that a cylinder array direction is in a vehicle front-rear direction. A vehicle component is arranged on a vehicle front side of the intake manifold, a fuel pipe through which fuel flows is arranged on a vehicle rear side of the intake manifold so as to extend in an up-down direction, the intake manifold includes: a plurality of independent intake pipe portions formed by branching and arranged side by side in the vehicle front-rear direction to provide one of the intake pipe portions for each of the cylinders; and a mounting portion that is provided on an intake-air downstream end side of the plurality of independent intake pipe portions and connects each of the plurality of independent intake pipe portions to the portion of the engine on one side of the engine in the vehicle width direction, the mounting portion has a front-side mounting portion relatively positioned on the vehicle front side and a rear-side mounting portion relatively positioned on the vehicle rear side, and the rear-side mounting portion is configured to have a higher rigidity than the front-side mounting portion.

With this configuration, at the time of a vehicle front collision, a case where the intake manifold retreats in a pileup manner can be prevented by deforming the front-side mounting portion by the collision load and preventing the rear-side mounting portion from deforming as much as possible. In particular, by absorbing the collision load by the deformation of the front-side mounting portion, the load received by the rear-side mounting portion can be reduced. Therefore, the deformation of the rear-side mounting portion can be prevented as much as possible. As a result, a case where the intake manifold and the fuel pipe interfere with each other at the time of a vehicle front collision can be prevented.

The intake manifold structure may have a configuration in which a thickness of the rear-side mounting portion in the vehicle width direction is thicker than a thickness of the front-side mounting portion in the vehicle width direction.

In other words, even when the rear-side mounting portion does not deform, there is a possibility that the rear-side mounting portion and the independent intake pipe portions fracture. With this configuration, even when the independent intake pipe portions fracture from the rear-side mounting portion by the collision load, the independent intake pipe portions fracture on the side farther from the engine than the front-side mounting portion. As a result, the intake manifold retreats while separating from the engine. In detail, when the independent intake pipe portions fracture from the mounting portion, fracturing occurs from the rear-side mounting portion after fracturing occurs from the front-side mounting portion. Therefore, when the independent intake pipe portions fracture from the rear-side mounting portion, the independent intake pipe portions fracture from the rear-side mounting portion while rotating to the rear side and the vehicle-width-direction outer side so as to pivot about the rear-side mounting portion. As a result, when the independent intake pipe portions fracture from the rear-side mounting portion, the independent intake pipe portions are in a state in which a force toward the rear side and the vehicle-width-direction outer side is applied thereto. Thus, the intake manifold retreats toward the rear side and the vehicle-width-direction outer side. Therefore, a case where the intake manifold and the fuel pipe interfere with each other can be prevented in a more effective manner.

The intake manifold structure may have a configuration in which the mounting portion has, on an outer peripheral surface, a plurality of lateral ribs that extend in the vehicle front-rear direction, and a number of the lateral ribs of the rear-side mounting portion is larger than a number of the lateral ribs of the front-side mounting portion.

With this configuration, the rigidity of the rear-side mounting portion becomes higher, and hence the deformation of the rear-side mounting portion can be prevented as much as possible. As a result, a case where the intake manifold and the fuel pipe interfere with each other at the time of a vehicle front collision can be prevented in a more effective manner.

The intake manifold structure in which the lateral ribs are provided on the mounting portion may have a configuration in which the mounting portion further has a plurality of vertical ribs that extend in the vehicle width direction so as to intersect with the plurality of lateral ribs, and the lateral ribs and the vertical ribs of the rear-side mounting portion are respectively thicker than the lateral ribs and the vertical ribs of the front-side mounting portion.

With this configuration, the rigidity of the rear-side mounting portion becomes higher, and hence the deformation of the rear-side mounting portion can be prevented in a more effective manner. As a result, a case where the intake manifold and the fuel pipe interfere with each other at the time of a vehicle front collision can be prevented in a more effective manner.

The intake manifold structure may have a configuration in which the intake manifold is made of resin.

With this configuration, as compared to when the intake manifold is made of metal, the structure in which a difference in rigidity occurs between the front-side mounting portion and the rear-side mounting portion is easily obtained. As a result, the structure that prevents the interference between the intake manifold and the fuel pipe interfere at the time of a vehicle front collision can be easily realized.

As described above, according to the technology disclosed herein, a case where the intake manifold and the fuel pipe interfere with each other at the time of a vehicle front collision can be prevented.

DETAILED DESCRIPTION

An exemplary embodiment is described in detail below with reference to the drawings. In the description below, front, rear, left, right, up, and down with respect to the vehicle are simply referred to as front, rear, left, right, up, and down. In the left-right direction, the left side when the front side is seen from the rear side is referred to as the left, and the right side thereof is referred to as the right.

Figure 1:
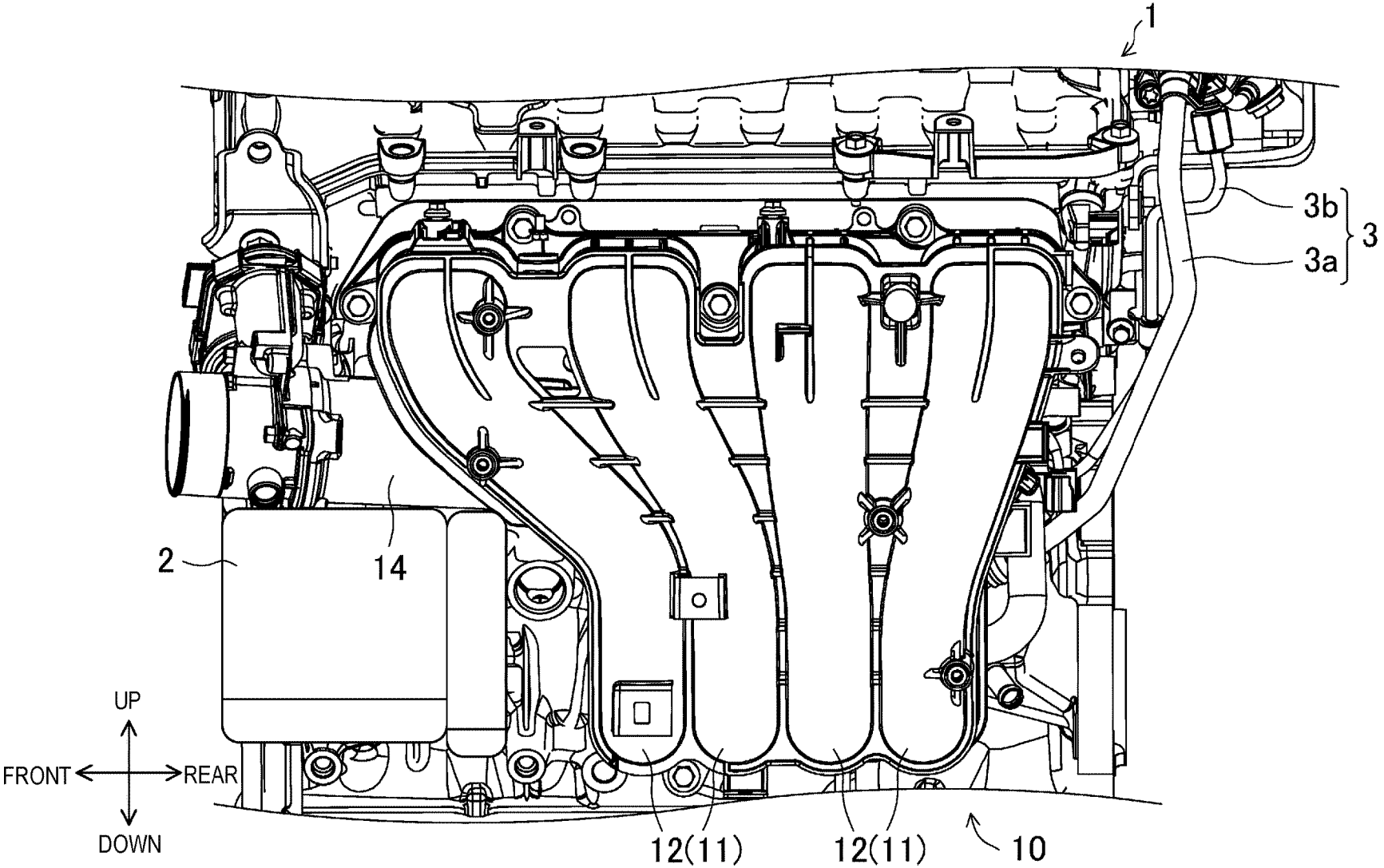
FIG. 1 is a side view of an engine having an intake manifold structure according to an exemplary embodiment.

FIG. 1 is a side view of an engine 1 seen from the left side. The engine 1 is a multiple cylinder engine and specifically has four cylinders. The engine 1 is longitudinally placed in an engine room of a vehicle such that the cylinder array direction is in the front-rear direction. The engine 1 is disposed such that the left side is the intake side and the right side is the exhaust side.

Figure 2:
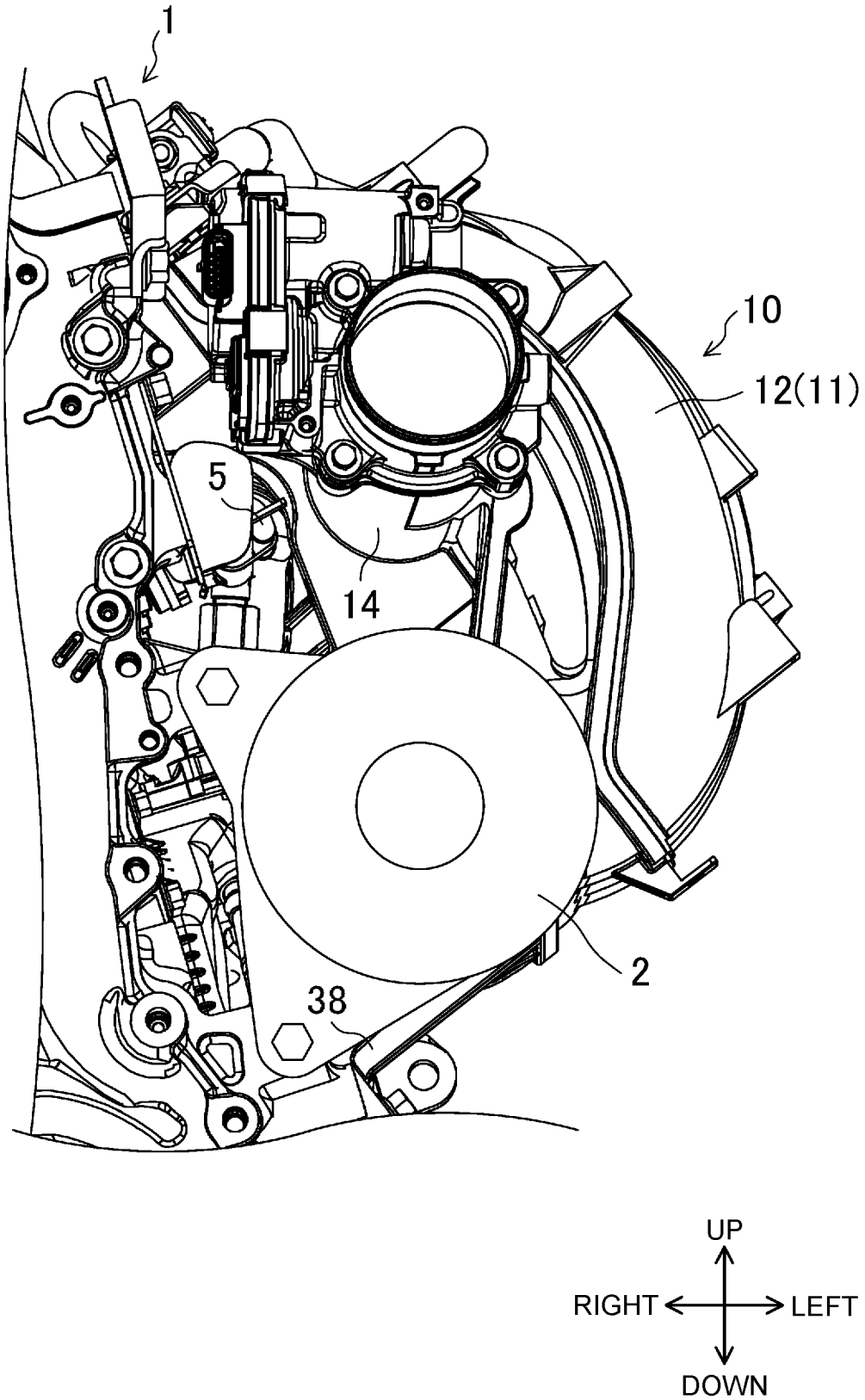
FIG. 2 is a front view illustrating the intake manifold of the engine in an enlarged manner.
Figure 3:
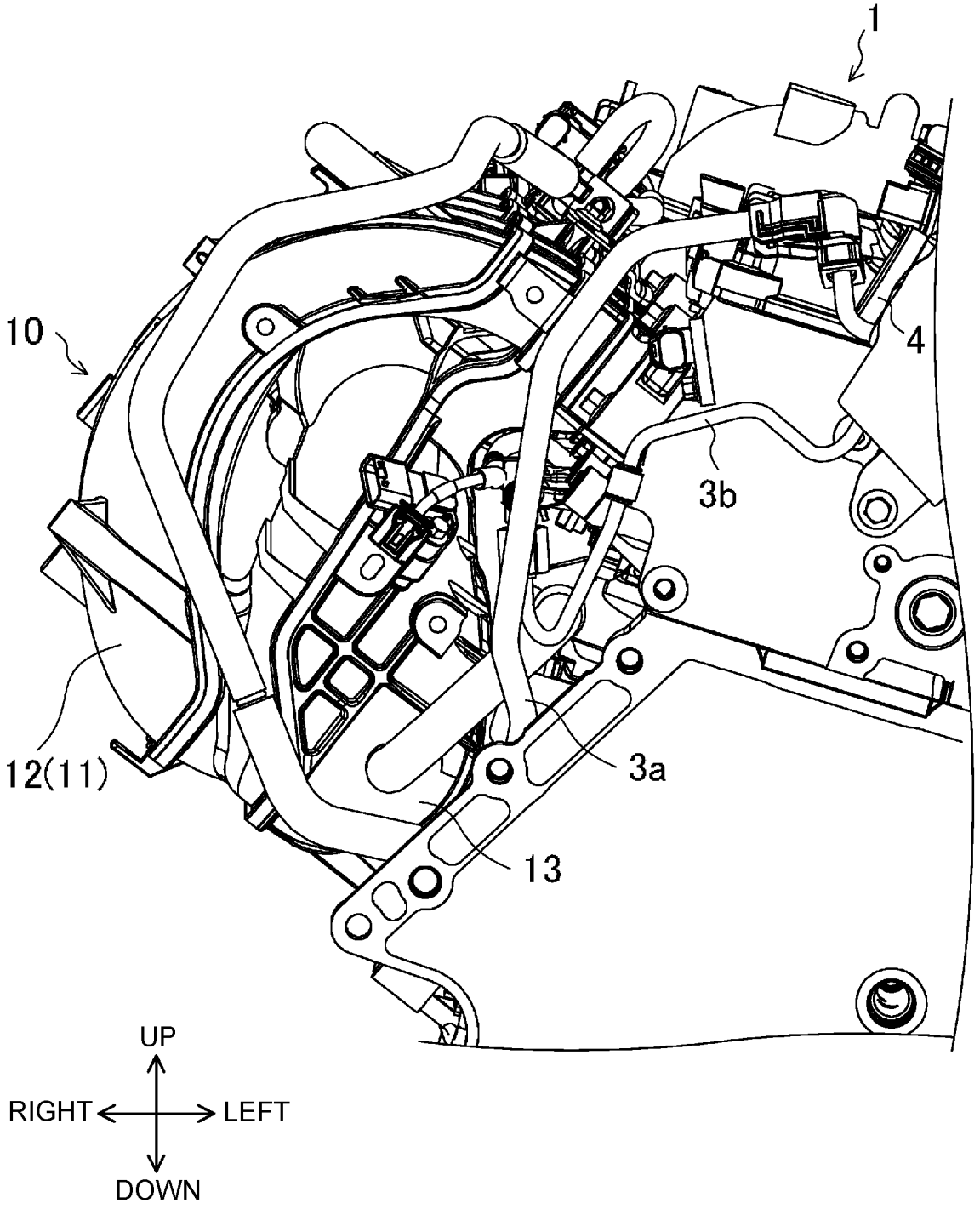
FIG. 3 is a rear view illustrating the intake manifold of the engine in an enlarged manner.

An intake manifold 10 for introducing intake air into the cylinders is connected to the left side face of a cylinder head of the engine 1. The intake manifold 10 is made of synthetic resin. As illustrated in FIG. 2 and FIG. 3, the intake manifold 10 has a plurality of (four herein) independent intake pipe portions 11 formed so as to branch for each cylinder and arranged side by side in the front-rear direction, a surge tank portion 13 that is connected to a lower end portion of each independent intake pipe portion 11 and distributes the intake air to each independent intake pipe portion 11, and an intake air introduction pipe 14 that extends to the front side from a portion of the surge tank portion 13 on the front side and the upper side thereof and is for introducing intake air from an intake pipe (not shown). Detailed configuration of the intake manifold 10 is described below.

As illustrated in FIG. 1, on the front side of the intake manifold 10, a vehicle component, in particular, an alternator 2 serving as an engine accessory is arranged. The alternator 2 generates electric power by the rotation of the engine and functions as a starter at the time of the starting of the engine. As illustrated in FIG. 1 and FIG. 2, the alternator 2 is arranged in the same position as the surge tank portion 13 and is arranged in a position that overlaps with the surge tank portion 13 when seen from the front side.

As illustrated in FIG. 1 and FIG. 3, a fuel pipe 3 through which fuel flows is arranged on the rear side of the intake manifold 10. As illustrated in FIG. 3, the fuel pipe 3 includes a low-pressure pipe 3*a* that supplies fuel to a fuel pump 4 from a fuel tank (not shown), and a high-pressure pipe 3*b* through which fuel of which pressure has been raised by the fuel pump 4. The low-pressure pipe 3*a* is made of a flexible resin tube. The high-pressure pipe 3*b* is made of a metal pipe. Both of the low-pressure pipe 3*a* and the high-pressure pipe 3*b* are arranged so as to extend in the up-down direction. An end portion of the high-pressure pipe 3*b* on the downstream side thereof is connected to a rear-side end portion of a fuel distribution pipe 5. The fuel distribution pipe 5 is a distribution pipe for supplying fuel to each cylinder and extends in the front-rear direction along the left side face of the engine 1. As illustrated in FIG. 3, the fuel distribution pipe 5 is arranged in a position between a mounting portion 33 described below and the surge tank portion 13.

The intake manifold 10 according to the present embodiment is described in detail below with reference to FIG. 4 to FIG. 11.

Figure 4:
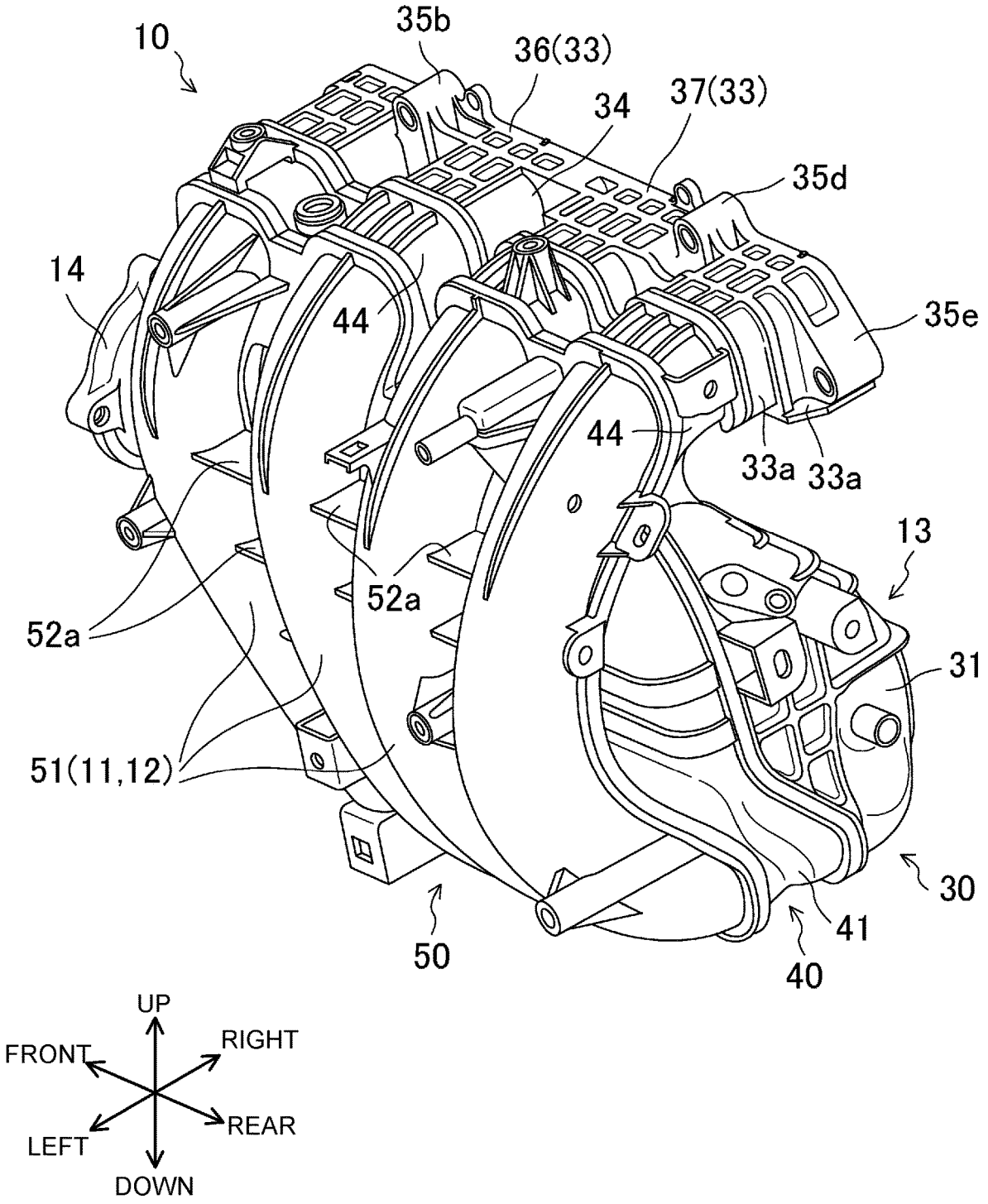
FIG. 4 is a perspective view of the intake manifold seen from the upper left side and the rear side.

As illustrated in FIG. 4, each independent intake pipe portion 11 of the intake manifold 10 is integrally connected to a portion of the surge tank portion 13 on the lower left side thereof. Each independent intake pipe portion 11 extends so as to be curved to the upper side and the right side from a portion connected to the surge tank portion 13 and is disposed so as to cover the upper side of the surge tank portion 13. At least some (in particular, the independent intake pipe portions 11 positioned on the front side) of the plurality of independent intake pipe portions 11 cover the upper side of the intake air introduction pipe 14. Each independent intake pipe portion 11 is in communication with the inside of the surge tank portion 13 at a lower end portion. The intake air passes through the intake air introduction pipe 14 and is accumulated in the surge tank portion 13. Then, the intake air passes through each independent intake pipe portion 11 and is introduced into the cylinder.

Figure 6:
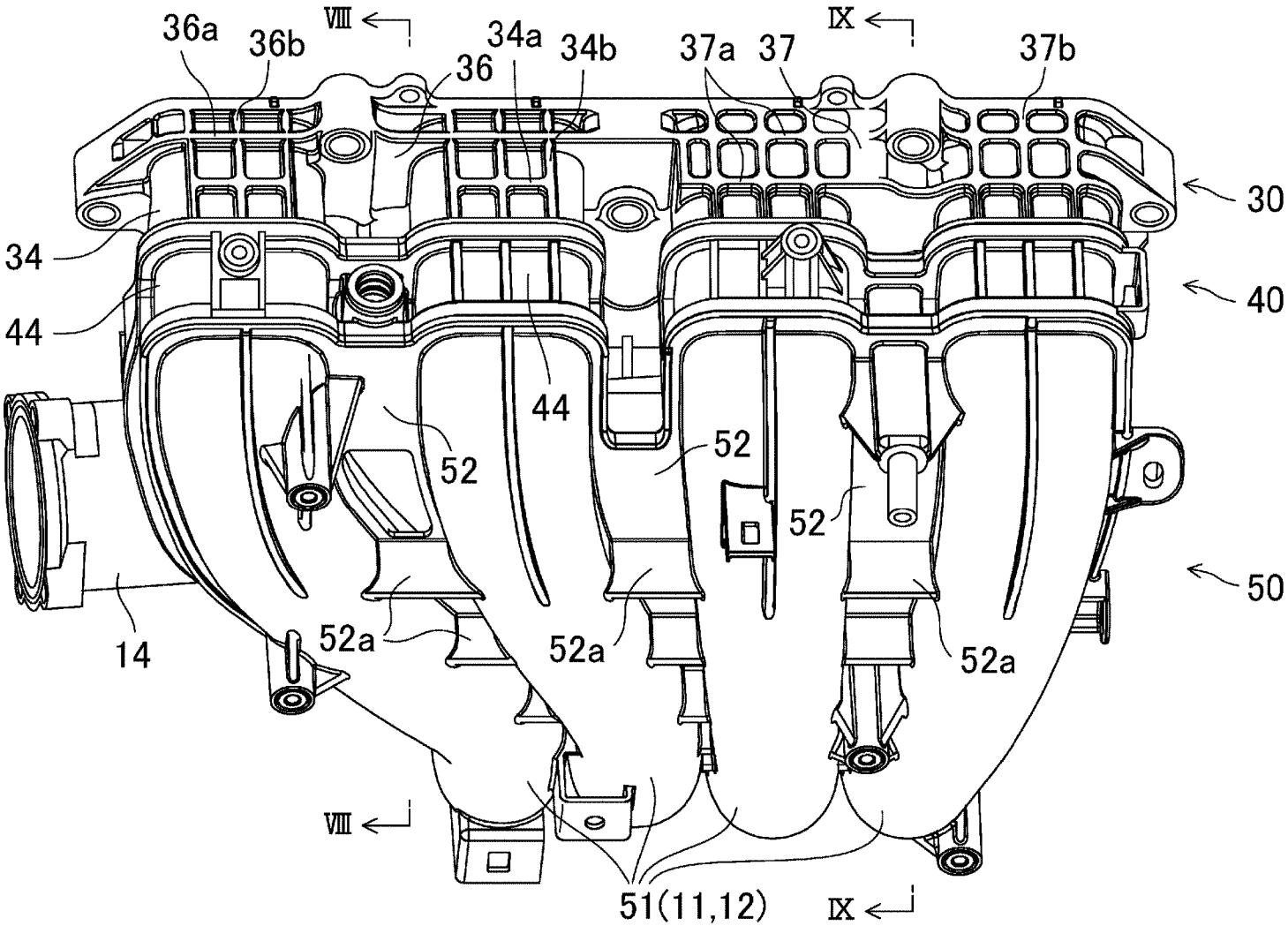
FIG. 6 is a plan view of the intake manifold.

As illustrated in FIG. 6, each independent intake pipe portion 11 has, in the order from the intake air upstream side, a main passage portion 12, an intermediate portion 44 (a portion of a second split piece 40 described below), and a downstream-side end portion 34 (a portion of a first split piece 30 described below). Each independent intake pipe portion 11 is formed by coupling the main passage portion 12, the intermediate portion 44, and the downstream-side end portion 34 to each other.

The main passage portions 12 of the independent intake pipe portions 11 are integrated with each other across the entirety in the longitudinal direction thereof. In other words, the main passage portions 12 adjacent to each other are coupled to each other via a coupling portion 52 positioned between both of the independent intake pipe portions 11. In the coupling portion 52, a plurality of lateral ribs 52*a* that spread in the front-rear direction and the left-right direction and are for improving the rigidity of the independent intake pipe portions 11 are provided.

Figure 8:
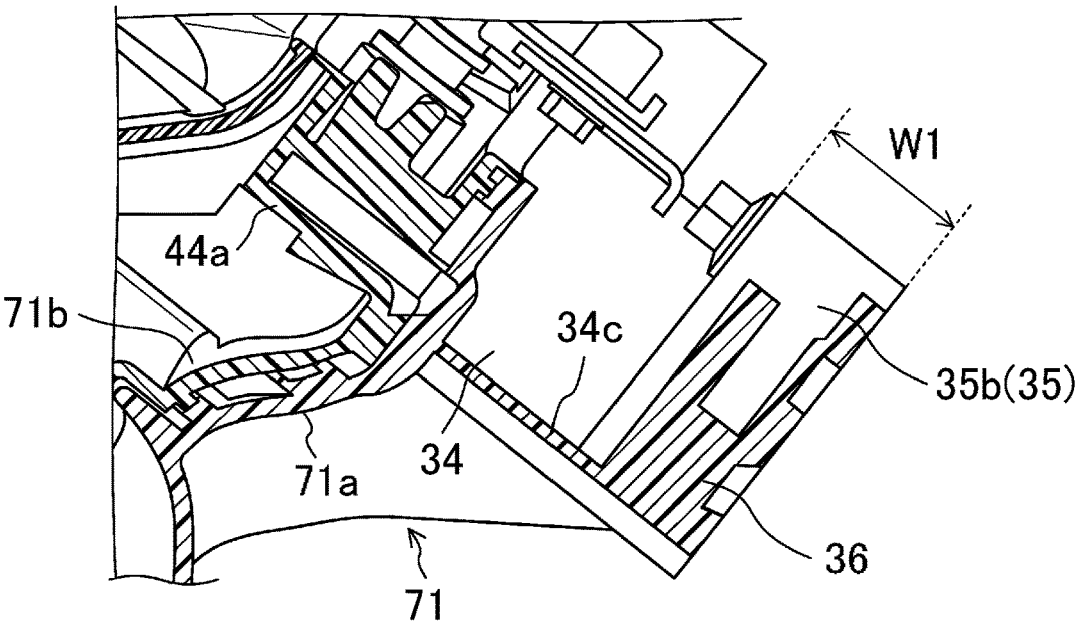
FIG. 8 is cross-sectional view taken along a plane equivalent to line VIII-VIII in FIG. 6.
Figure 9:
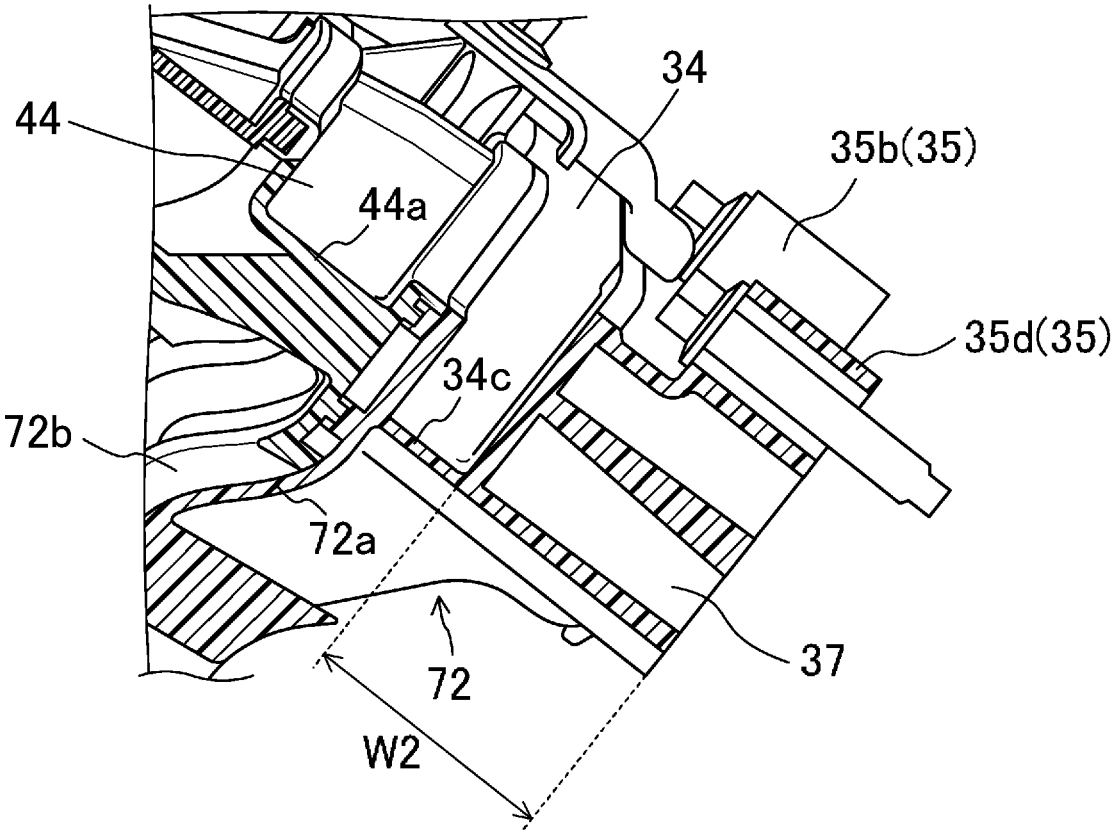
FIG. 9 is a cross-sectional view taken along a plane equivalent to line IX-IX in FIG. 6.

Regarding the intermediate portions 44, the intermediate portions 44 adjacent to each other are coupled to each other via a coupling portion 44*a* (see FIG. 8 and FIG. 9). The intermediate portions 44 each have vertical ribs that extend in the left-right direction except for the intermediate portion 44 on the frontmost side.

Regarding the downstream-side end portions 34, the downstream-side end portions 34 adjacent to each other are coupled to each other via a coupling portion 34*c* (see FIG. 8 and FIG. 9). Regarding the downstream-side end portions 34, the two downstream-side end portions 34 on the rear side are shorter than the two downstream-side end portions 34 on the front sides. In the two downstream-side end portions 34 on the front side, lateral ribs 34*a* that extend in the front-rear direction and vertical ribs 34*b* that extend in the left-right direction are formed so as to be orthogonal to each other and form a knitted stitch form. In the two downstream-side end portions 34 on the rear side, the lateral ribs 34*a* are not formed and only the vertical ribs 34*b* are formed. Each of the vertical ribs 34*b* is formed to be continuous to front-side vertical ribs 36*b* and rear-side vertical ribs 37*b* described below.

Figure 5:
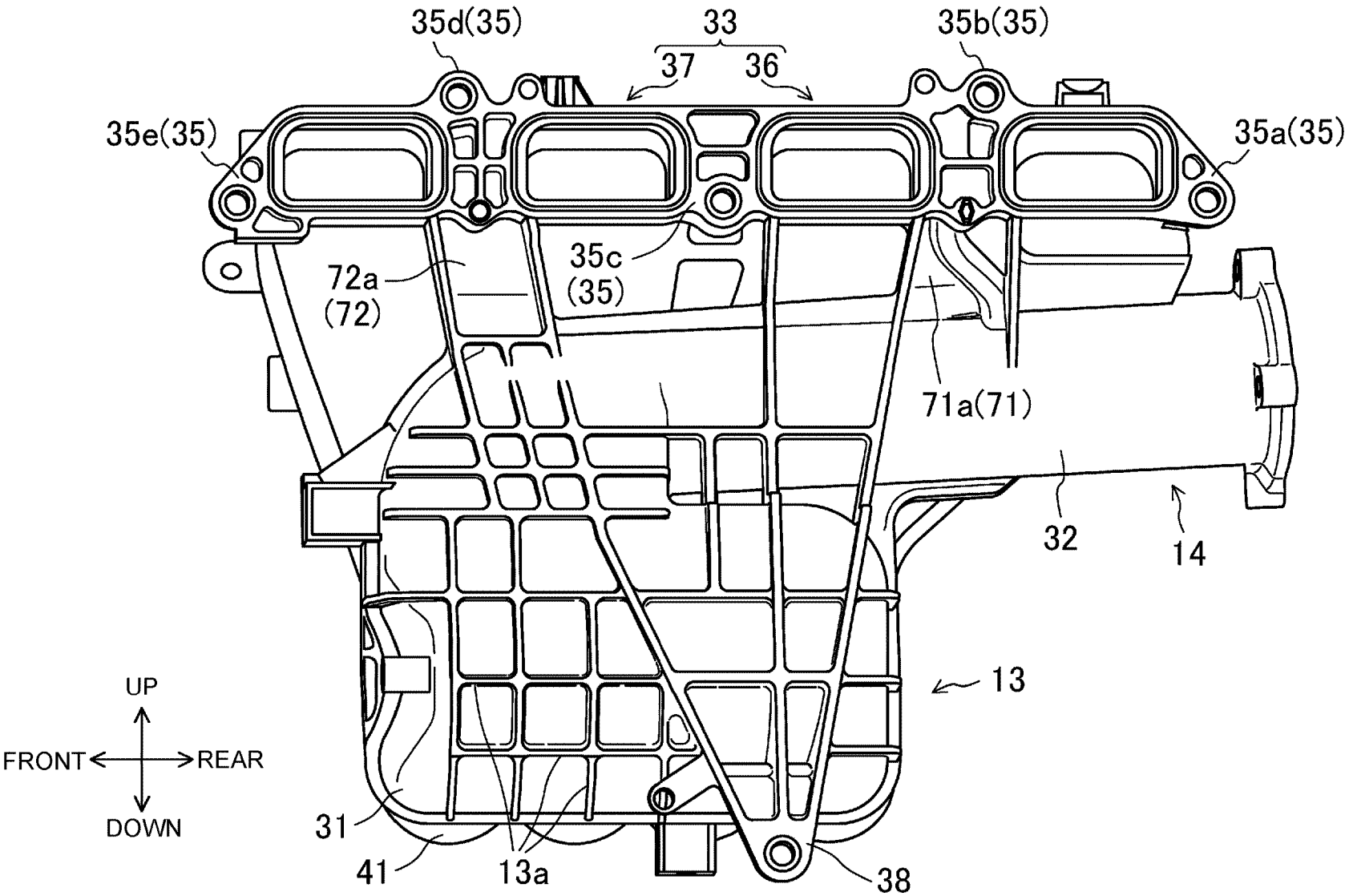
FIG. 5 is a side view of a first split piece of the intake manifold seen from the right side.

As illustrated in FIG. 5 and FIG. 6, end portions (in other words, portions on the most downstream side of the downstream-side end portions 34) of the independent intake pipe portions 11 on the side opposite from the surge tank portion 13 are integrated with each other and serve as the mounting portion 33 for mounting the intake manifold 10 on a cylinder block of the engine 1. The mounting portion 33 is positioned in a position apart from the surge tank portion 13 to the upper side.

Figure 7:
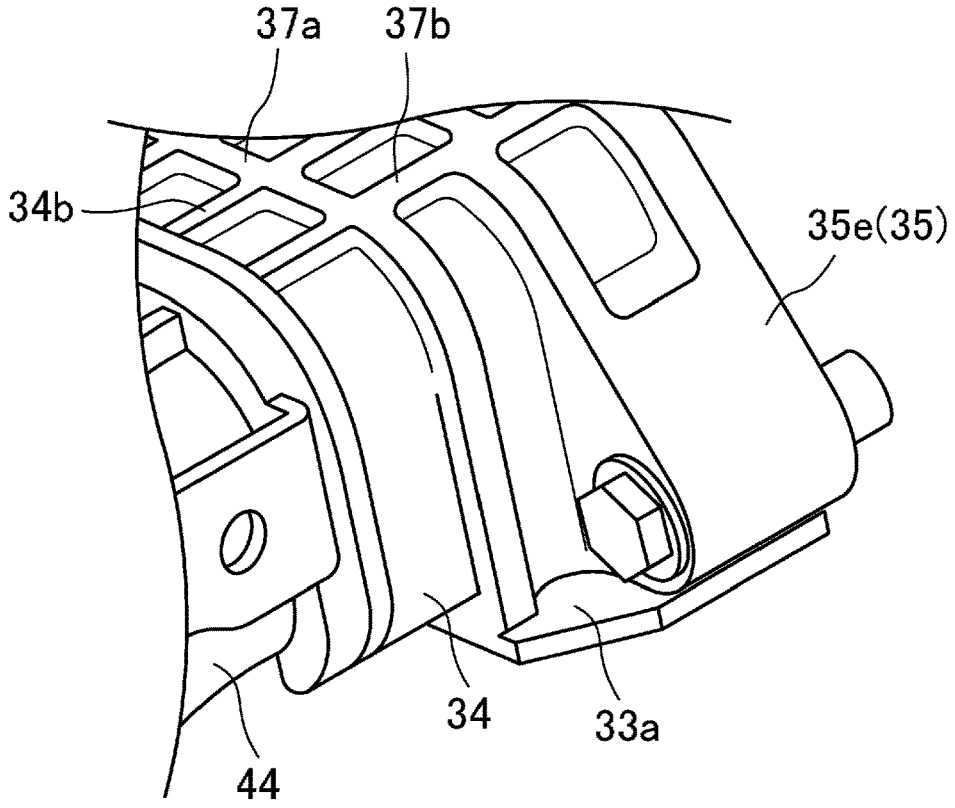
FIG. 7 is an enlarged perspective view illustrating a fifth fastening portion in an enlarged manner.

The mounting portion 33 spreads in the front-rear direction so as to integrate the plurality of independent intake pipe portions 11 with each other. The mounting portion 33 is formed in flange shape. The mounting portion 33 has a plurality of fastening portions 35 (five herein) fastened and fixed to a left side face of the cylinder head of the engine 1 by bolts 62 (see FIG. 1). As illustrated in FIG. 5, the fastening portions 35 are provided on a front-side portion of the independent intake pipe portion 11 on the frontmost side, portions each between the independent intake pipe portions 11 that are adjacent to each other, and a rear-side portion of the independent intake pipe portion 11 on the rearmost side. The plurality of fastening portions 35 are arranged in a staggered form in the up-down direction with respect to the front-rear direction. Specifically, when the plurality of fastening portions 35 are referred to as a first fastening portion 35*a*, a second fastening portion 35*b*, a third fastening portion 35*c*, a fourth fastening portion 35*d*, and a fifth fastening portion 35*e* from the front side, the first fastening portion 35*a*, the third fastening portion 35*c*, and the fifth fastening portion 35*e* are relatively positioned on the lower side, and the second fastening portion 35*b* and the fourth fastening portion 35*d* are relatively positioned on the upper side. As illustrated in FIG. 7, the fifth fastening portion 35*e* is formed to be thicker than the first fastening portion 35*a* in the left-right direction. A reinforcement rib 33*a* is provided between the fifth fastening portion 35*e* and an end portion of the mounting portion 33 on the rear side and the lower side thereof. As a result, the rigidity of a portion in the periphery of the fifth fastening portion 35*e* is higher than that of the other fastening portions 35*a* to 35*d*.

The mounting portion 33 has a front-side mounting portion 36 relatively positioned on the front side, and a rear-side mounting portion 37 relatively positioned on the rear side. The front-side mounting portion 36 is a portion that couples the two independent intake pipe portions 11 on the front side out of the plurality of independent intake pipe portions 11 to each other in the front-rear direction, and the rear-side mounting portion 37 is a portion that couples the two independent intake pipe portions 11 on the rear side out of the plurality of independent intake pipe portions 11 to each other in the front-rear direction. As illustrated in FIG. 6, the front-side mounting portion 36 extends to a position of the third fastening portion 35*c*.

As illustrated in FIG. 6, in the front-side mounting portion 36, a plurality of front-side lateral ribs 36*a* that extend in the front-rear direction and a plurality of front-side vertical ribs 36*b* that extend in the left-right direction are provided so as to be orthogonal to each other and form a knitted stitch form. In the rear-side mounting portion 37, a plurality of rear-side lateral ribs 37*a* that extend in the front-rear direction and a plurality of rear-side vertical ribs 37*b* that extend in the left-right direction are provided so as to be orthogonal to each other and form a knitted stitch form. Two front-side lateral ribs 36*a* are formed, and three rear-side lateral ribs 37*a* are formed. In other words, the number of the rear-side lateral ribs 37*a* is larger than the number of the front-side lateral ribs 36*a*. The rear-side lateral ribs 37*a* and the rear-side vertical ribs 37*b* are thicker than the front-side lateral ribs 36*a* and the front-side vertical ribs 36*b*. As a result, the rigidity of the rear-side mounting portion 37 is higher than that of the front-side mounting portion 36.

FIG. 8 is a cross-section of the front-side mounting portion 36 taken along the position of the second fastening portion 35*b*, and FIG. 9 is a cross-section of the rear-side mounting portion 37 taken along the position of the fourth fastening portion 35*d*. As illustrated in FIG. 8 and FIG. 9, a thickness W2 of the rear-side mounting portion 37 in the left-right direction (in other words, the vehicle width direction) is thicker than a thickness W1 of the front-side mounting portion 36 in the left-right direction. Specifically, the thickness W2 of the rear-side mounting portion 37 is about twice as thick as the thickness of the front-side mounting portion 36. As a result, the rigidity of the rear-side mounting portion 37 is higher than that of the front-side mounting portion 36.

As illustrated in FIG. 5, the surge tank portion 13 is configured to be continuous to a rear end portion of the intake air introduction pipe 14 and spreads to the front-rear direction and the left-right direction. The surge tank portion 13 forms an elliptical shape of which up-down direction is longer than the left-right direction when seen from the front-rear direction (see FIG. 3). The surge tank portion 13 has a plurality of reinforcement ribs 13*a* for enhancing the rigidity in a portion on the right side thereof.

The intake air introduction pipe 14 extends to be inclined to the right side toward the rear side. The intake air introduction pipe 14 is prevented from bulging out to the right side than the surge tank portion 13. Specifically, in a state of being mounted on the engine 1, a top portion in the intake air introduction pipe 14 on the rightmost side thereof is formed to be in a substantially same position as a right side-face portion of the surge tank portion 13 in the left-right direction.

As illustrated in FIG. 5, front-side and rear-side cross-linking portions 71, 72 that couple a surge tank base portion 31 described below, an introduction pipe base portion 32, and the mounting portion 33 to each other are provided in a portion of the intake manifold 10 on the right side thereof so as to extend in the up-down direction in order to ensure the rigidity of the intake manifold 10. The front-side cross-linking portion 71 is provided in a position of the second fastening portion 35*b* in the front-rear direction. An upper end portion of the front-side cross-linking portion 71 is coupled to a lower end portion of the front-side mounting portion 36, lower end portions of the downstream-side end portions 34 on the front side, and a lower end portion of the intermediate portion 44 on the front side. A lower end portion of the front-side cross-linking portion 71 is coupled to a portion of the intake air introduction pipe 14 on the upper side and the right side thereof. An upper end portion of the front-side cross-linking portion 71 is formed so as to couple the two independent intake pipe portions 11 on the front side to each other in the front-rear direction. The rear-side cross-linking portion 72 is provided in a position of the fourth fastening portion 35*d* in the front-rear direction. An upper end portion of the rear-side cross-linking portion 72 is coupled to a lower end portion of the rear-side mounting portion 37, lower end portions of the downstream-side end portions 34 on the rear side, and a lower end portion of the intermediate portion 44 on the rear side. A lower end portion of the rear-side cross-linking portion 72 is coupled to an end portion of the surge tank portion 13 on the upper side and the rear side thereof. An upper end portion of the rear-side cross-linking portion 72 is formed so as to couple the two independent intake pipe portions 11 on the rear side to each other in the front-rear direction.

Figure 10:
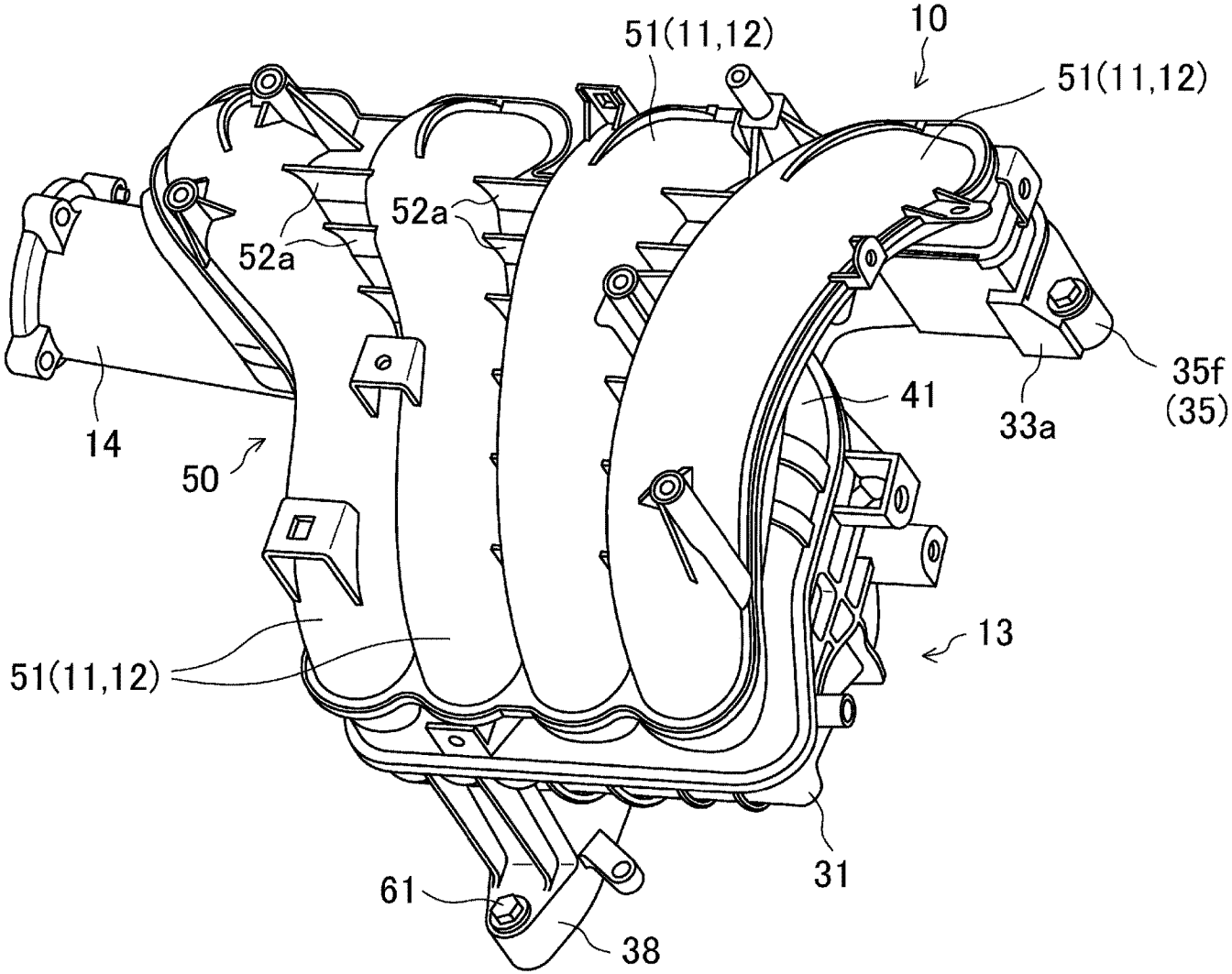
FIG. 10 is a perspective view of the intake manifold seen from the lower left side and the rear side.

A protrusion 38 that protrudes downward is formed on a lower portion of the surge tank portion 13. As illustrated in FIG. 10, the protrusion 38 is formed so as to protrude toward the right side (in other words, the engine side) in addition to the lower side. A lower end portion of the protrusion 38 is fastened and fixed to a left side face of the cylinder block of the engine 1 via a bolt 61.

In the present embodiment, the intake manifold 10 is composed of three split pieces split in the left-right direction (vehicle width direction). Specifically, the intake manifold 10 has a first split piece 30 positioned on the side closest to the engine 1 (right side), a third split piece 50 positioned on the side farthest from the engine 1 (left side), and a second split piece 40 positioned between the first split piece 30 and the third split piece 50. Each of the first to third split pieces 30, 40, 50 is separately molded in an integral manner by resin by a mold. After the molding, the first to third split pieces 30, 40, 50 are integrated with each other by being coupled with each other by vibration welding. As a result, no gaps are formed between the first to third split pieces 30, 40, 50.

The first split piece 30 constitutes a right-side portion (hereinafter referred to as the surge tank base portion 31) of the surge tank portion 13, the entirety of a front-side portion and a right-side portion of a rear-side portion (hereinafter referred to as an introduction pipe base portion 32) of the intake air introduction pipe 14, the mounting portion 33, a right-side portion 71*a* of the front-side cross-linking portion 71, a right-side portion 72*a* of the rear-side cross-linking portion 72, the downstream-side end portions 34 of the independent intake pipe portions 11, and the protrusion 38. As illustrated in FIG. 12, the second split piece 40 constitutes a left-side portion (hereinafter referred to as an other surge tank portion 41) of the surge tank portion 13, a left-side portion (hereinafter referred to as an other introduction pipe portion 42) of a rear-side portion of the intake air introduction pipe 14, right-side portions (hereinafter referred to as an independent pipe base portion 43) of the main passage portions 12 of the independent intake pipe portions 11, the intermediate portions 44 between the main passage portions 12 of the independent intake pipe portions 11 and the downstream-side end portion 34, a left-side portion 71*b* of the front-side cross-linking portion 71, and a left-side portion 72*b* of the rear-side cross-linking portion 72. The third split piece 50 constitutes left-side portions (hereinafter referred to as other independent pipe portions 51) of the main passage portions 12 of the independent intake pipe portions 11, the coupling portions 52 of the main passage portions 12, and the lateral ribs 52*a* of the coupling portions 52.

The surge tank portion 13 is formed by fitting the first split piece 30 and the second split piece 40 with each other in the surge tank portion 13. The surge tank portion 13 is formed by fitting the surge tank base portion 31 that is half-split in the first split piece 30 and the other surge tank portion 41 that is half-split in the second split piece 40 with each other.

The intake air introduction pipe 14 is formed by fitting the first split piece 30 and the second split piece 40 with each other in the intake air introduction pipe 14. The surge tank portion 13 is formed by fitting the introduction pipe base portion 32 that is half-split in the first split piece 30 and the other introduction pipe portion 42 that is half-split in the second split piece 40 with each other.

Figure 11:
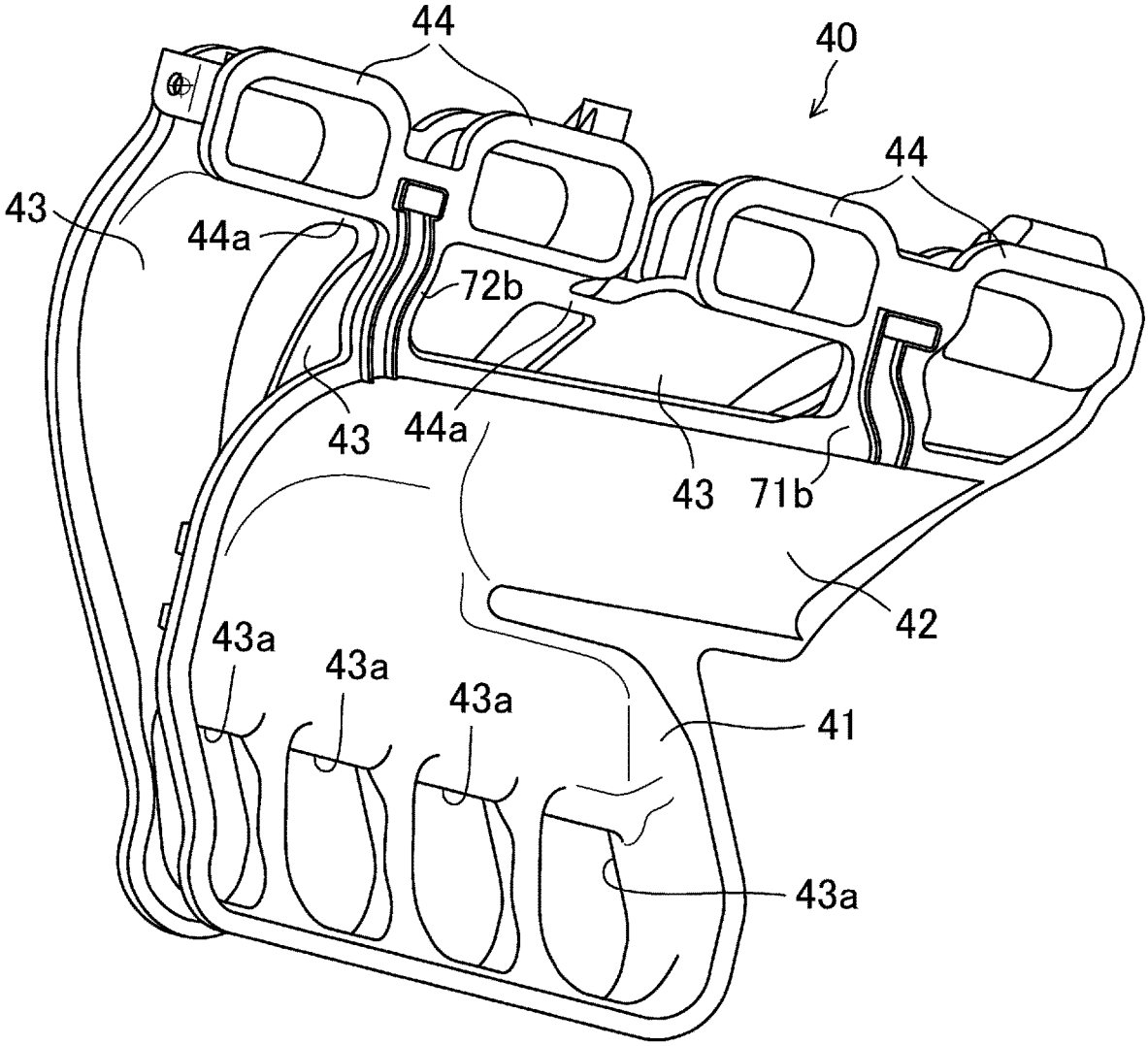
FIG. 11 is a perspective view of a second split piece of the intake manifold.

The main passage portions 12 in the independent intake pipe portions 11 are formed by fitting the second split piece 40 and the third split piece 50 with each other in the main passage portions 12. In other words, the main passage portions 12 are formed by fitting the independent pipe base portion 43 that is half-split in the second split piece 40 and the other independent pipe portion 51 that is half-split in the third split piece 50 with each other (see FIG. 10). As illustrated in FIG. 11, in the independent pipe base portion 43, a plurality of (four herein) communication holes 43*a* that communicate with the inside of the surge tank portion 13 are formed so as to correspond to the independent intake pipe portions 11, respectively. Intake air is introduced to the independent intake pipe portions 11 from the surge tank portion 13 via the communication holes 43*a*.

The independent intake pipe portions 11 are formed across the entire longitudinal direction thereof by coupling the first to third split pieces 30, 40, 50 to each other. The portions of the independent intake pipe portions 11 that are on the downstream side of the main passage portions 12 are formed by coupling the downstream-side end portions 34 of the first split piece 30 and the intermediate portions 44 of the second split piece 40 to each other in the left-right direction.

The front-side cross-linking portion 71 is formed by fitting the first split piece 30 and the second split piece 40 with each other in the front-side cross-linking portion 71. In other words, the front-side cross-linking portion 71 is formed by fitting the right-side portion 71*a* of the first split piece 30 and the left-side portion 71*b* of the second split piece 40 with each other.

The rear-side cross-linking portion 72 is formed by fitting the first split piece 30 and the second split piece 40 with each other in the rear-side cross-linking portion 72. In other words, the rear-side cross-linking portion 72 is formed by fitting the right-side portion 72*a* of the first split piece 30 and the left-side portion 72*b* of the second split piece 40 with each other.

As in the present embodiment, when the alternator 2 is arranged in front of the intake manifold 10, the alternator 2 retreats and abuts against the intake manifold 10 at the time of the vehicle front collision. As a result, when the intake manifold 10 retreats in a pileup manner, the intake manifold 10 might interfere with the fuel pipe 3.

Meanwhile, in the present embodiment, the rigidity of the rear-side mounting portion 37 is higher than that of the front-side mounting portion 36. As a result, when the alternator 2 and the intake manifold 10 abut against each other, a case where the intake manifold 10 retreats in a pileup manner can be prevented by deforming the front-side mounting portion 36 by the collision load and preventing the rear-side mounting portion 37 from deforming as much as possible. In particular, the front-side mounting portion 36 deforms and absorbs the collision load. As a result, the load received by the rear-side mounting portion 37 can be reduced. Therefore, the deformation of the rear-side mounting portion 37 can be prevented as much as possible. As a result, a case where the intake manifold 10 and the fuel pipe 3 interfere with each other at the time of a vehicle front collision can be prevented.

In the present embodiment, the thickness W2 of the rear-side mounting portion 37 in the vehicle width direction is thicker than the thickness W1 of the front-side mounting portion 36 in the vehicle width direction. As a result, even when the independent intake pipe portions 11 fracture from the rear-side mounting portion 37 by the collision load, the independent intake pipe portions 11 fracture on the side farther from the engine 1 than the front-side mounting portion 36. In detail, when the independent intake pipe portions 11 fracture from the mounting portion 33, fracturing occurs from the rear-side mounting portion 37 after fracturing occurs from the front-side mounting portion 36 of which rigidity is relatively weak. Therefore, when the independent intake pipe portions 11 fracture from the rear-side mounting portion 37, the independent intake pipe portions 11 fracture from the rear-side mounting portion 37 while rotating to the rear side and the vehicle-width-direction outer side so as to pivot about the rear-side mounting portion 37. As a result, when the independent intake pipe portions 11 fracture from the rear-side mounting portion 37, the independent intake pipe portions 11 are in a state in which a force toward the rear side and the vehicle-width-direction outer side is applied thereto. Thus, the intake manifold 10 retreats toward the rear side and the vehicle-width-direction outer side. Therefore, a case where the intake manifold 10 and the fuel pipe 3 interfere with each other at the time of a vehicle front collision can be prevented in a more effective manner.

In particular, in the present embodiment, the alternator 2 is in the same height position as the surge tank portion 13. Therefore, when the alternator 2 retreats, the alternator 2 abuts against the surge tank portion 13. Therefore, a force that rotates toward the rear side and the upper side so as to pivot about the mounting portion 33 acts on the intake manifold 10. At this time, the rigidity of the rear-side mounting portion 37 is high, and hence pivoting easily occurs about the rear-side mounting portion 37. As a result, the independent intake pipe portions 11 connected to the front-side mounting portion 36 are easily twisted, and the independent intake pipe portions 11 easily fracture from the front-side mounting portion 36 before the rear-side mounting portion 37. Therefore, when the independent intake pipe portions 11 fracture from the mounting portion 33, the intake manifold 10 retreats toward the rear side and the vehicle-width-direction outer side. Therefore, a case where the intake manifold 10 and the fuel pipe 3 interfere with each other at the time of a vehicle front collision can be prevented in a more effective manner.

In the present embodiment, the mounting portion 33 has, on an outer peripheral surface, the plurality of front-side lateral ribs 36*a* and rear-side lateral ribs 37*a* that extend in the vehicle front-rear direction, and the number of the rear-side lateral ribs 37*a* is larger than the number of the front-side lateral ribs 36*a*.

In the present embodiment, the mounting portion 33 further has the plurality of front-side vertical ribs 36*b* and rear-side vertical ribs 37*b* that extend in the vehicle width direction so as to intersect with the plurality of front-side lateral ribs 36*a* and rear-side lateral ribs 37*a*, and the rear-side lateral ribs 37*a* and the rear-side vertical ribs 37*b* are respectively thicker than the front-side lateral ribs 36*a* and the front-side vertical ribs 36*b*.

By those configurations, the rigidity of the rear-side mounting portion 37 becomes higher, and hence the deformation of the rear-side mounting portion 37 can be prevented as much as possible. As a result, a case where the intake manifold 10 and the fuel pipe 3 interfere with each other at the time of a vehicle front collision can be prevented in a more effective manner.

In the present embodiment, the reinforcement rib 33*a* is provided between the fifth fastening portion 35*e* and an end portion of the mounting portion 33 on the rear side and the lower side thereof. As a result, the rigidity of a portion in the periphery of the fifth fastening portion 35*e* becomes higher than that of the other fastening portions 35*a* to 35*d*. As a result, the deformation of the rear-side mounting portion 37 can be prevented as much as possible. As a result, a case where the intake manifold 10 and the fuel pipe 3 interfere with each other at the time of a vehicle front collision can be prevented in a more effective manner.

OTHER EMBODIMENTS

The technology disclosed herein is not limited to the abovementioned embodiment, and substitution is possible without departing from the gist of the claims.

For example, the intake manifold structure is applied to a four-cylinder engine in the abovementioned embodiment. The present disclosure is not limited to the above, and the abovementioned intake manifold structure can be applied to an engine as long as the engine is an engine having two or more cylinders.

In the abovementioned embodiment, the rigidity of the rear-side mounting portion 37 is caused to be higher than that of the front-side mounting portion 36 by causing the thickness of the rear-side mounting portion 37 in the vehicle width direction to be thicker than the thickness of the front-side mounting portion 36 in the vehicle width direction. The present disclosure is not limited thereto. After causing the thickness of the rear-side mounting portion 37 in the vehicle width direction to be the same as the thickness of the front-side mounting portion 36 in the vehicle width direction, the rigidity of the rear-side mounting portion 37 may be caused to be higher than that of the front-side mounting portion 36 by causing the number of the rear-side lateral ribs 37*a* and rear-side vertical ribs 37*b* to be larger than the number of front-side lateral ribs 36*a* and front-side vertical ribs 36*b* or causing the thicknesses of the rear-side lateral ribs 37*a* and the rear-side vertical ribs 37*b* to be thicker than those of the front-side lateral ribs 36*a* and the front-side vertical ribs 36*b*.

In the abovementioned embodiment, the alternator is exemplified as the vehicle component. The present disclosure is not limited to the above, and the vehicle component may be a motor or a battery, for example.

The abovementioned embodiments are merely exemplifications and should not be interpreted by limiting to the scope of the present disclosure. The scope of the present disclosure is defined by the claims, and all modifications and changes belonging to a scope equivalent to the claims are within the scope of the present disclosure.

The technology disclosed herein is useful as an intake manifold structure including an intake manifold connected to a portion of a multiple cylinder engine on one side thereof in the vehicle width direction where the multiple cylinder engine is longitudinally placed in an engine room such that the cylinder array direction is in the vehicle front-rear direction.

What is claimed is:

1. An intake manifold structure comprising an intake manifold connected to a portion of a multiple cylinder engine on one side of the multiple cylinder engine in a vehicle width direction, the multiple cylinder engine being longitudinally placed in an engine room such that a cylinder array direction is in a vehicle front-rear direction, wherein: a vehicle component is arranged on a vehicle front side of the intake manifold; a fuel pipe through which fuel flows is arranged on a vehicle rear side of the intake manifold so as to extend in an up-down direction; the intake manifold includes a plurality of independent intake pipe portions formed by branching and arranged side by side in the vehicle front-rear direction to provide one of the intake pipe portions for each of the cylinders, and a mounting portion on an intake-air downstream end side of the plurality of independent intake pipe portions connecting each of the plurality of independent intake pipe portions to the portion of the engine on one side of the engine in the vehicle width direction; the mounting portion has a front-side mounting portion relatively positioned on a vehicle front side and a rear-side mounting portion relatively positioned on a vehicle rear side; the rear-side mounting portion has a higher rigidity than the front-side mounting portion; and a thickness of the rear-side mounting portion in the vehicle width direction is thicker than a thickness of the front-side mounting portion in the vehicle width direction.

2. The intake manifold structure according to claim 1, wherein: the mounting portion has, on an outer peripheral surface, a plurality of lateral ribs that extend in the vehicle front-rear direction; and a number of the lateral ribs of the rear-side mounting portion is larger than a number of the lateral ribs of the front-side mounting portion.

3. The intake manifold structure according to claim 2, wherein:

the mounting portion further has a plurality of vertical ribs that extend in the vehicle width direction so as to intersect with the plurality of lateral ribs; and the lateral ribs and the vertical ribs of the rear-side mounting portion are respectively thicker than the lateral ribs and the vertical ribs of the front-side mounting portion.

4. The intake manifold structure according to claim 3, wherein the intake manifold is made of resin.

5. An intake manifold structure comprising an intake manifold connected to a portion of a multiple cylinder engine on one side of the multiple cylinder engine in a vehicle width direction, the multiple cylinder engine being longitudinally placed in an engine room such that a cylinder array direction is in a vehicle front-rear direction, wherein: a vehicle component is arranged on a vehicle front side of the intake manifold; a fuel pipe through which fuel flows is arranged on a vehicle rear side of the intake manifold so as to extend in an up-down direction; the intake manifold includes a plurality of independent intake pipe portions formed by branching and arranged side by side in the vehicle front-rear direction to provide one of the intake pipe portions for each of the cylinders, and a mounting portion on an intake-air downstream end side of the plurality of independent intake pipe portions connecting each of the plurality of independent intake pipe portions to the portion of the engine on one side of the engine in the vehicle width direction; the mounting portion has a front-side mounting portion relatively positioned on a vehicle front side and a rear-side mounting portion relatively positioned on a vehicle rear side; the rear-side mounting portion has a higher rigidity than the front-side mounting portion; the mounting portion has, on an outer peripheral surface, a plurality of lateral ribs that extend in the vehicle front-rear direction; and a number of the lateral ribs of the rear-side mounting portion is larger than a number of the lateral ribs of the front-side mounting portion.

6. The intake manifold structure according to claim 1, wherein the intake manifold is made of resin.

7. The intake manifold structure according to claim 2, wherein the intake manifold is made of resin.

8. The intake manifold structure according to claim 5, wherein:

the mounting portion further has a plurality of vertical ribs that extend in the vehicle width direction so as to intersect with the plurality of lateral ribs; and the lateral ribs and the vertical ribs of the rear-side mounting portion are respectively thicker than the lateral ribs and the vertical ribs of the front-side mounting portion.

9. The intake manifold structure according to claim 5, wherein the intake manifold is made of resin.

10. The intake manifold structure according to claim 8, wherein the intake manifold is made of resin.

* * * * *